United States Patent [19]

Gross et al.

[11] Patent Number: 4,807,624

[45] Date of Patent: Feb. 28, 1989

[54] DEVICE FOR REMOVING HAIR

[75] Inventors: Joseph Gross, Moshav Mazor; David Lowenstein, Natanya; Menahem Tilman, Hofit; Etan Rosenberg, Kiryai Ono, all of Israel

[73] Assignee: Hair Remover Ltd., Tel Aviv, Israel

[21] Appl. No.: 163,356

[22] Filed: Mar. 2, 1988

[30] Foreign Application Priority Data

Mar. 25, 1987 [IL] Israel ..... 82002

[51] Int. Cl.[4] ..... A61B 17/00

[52] U.S. Cl. ..... 128/355; 17/11.1 R

[58] Field of Search ..... 128/354, 355; 17/11.1, 17/47

[56] References Cited

U.S. PATENT DOCUMENTS

| | | | |
|---|---|---|---|
| 2,900,661 | 8/1959 | Schnell | 128/355 X |
| 4,079,741 | 3/1978 | Daar et al. | 128/355 |
| 4,279,253 | 7/1981 | Haes et al. | 128/355 |
| 4,524,772 | 6/1985 | Daar et al. | 128/355 |
| 4,726,375 | 2/1988 | Gross et al. | 128/355 |

FOREIGN PATENT DOCUMENTS

| | | | |
|---|---|---|---|
| 147285 | 7/1985 | European Pat. Off. | 128/355 |

*Primary Examiner*—Dalton L. Truluck

*Attorney, Agent, or Firm*—Benjamin J. Barish

[57] ABSTRACT

A device for removing body hair comprises a manually-grippable housing, and a hair-plucker body including a stack of circular discs of uniform diameter fixed to a resilient cylindrical core of smaller diameter passing through their centers. The core is supported in an arcuate position and is rotated about its longitudinal axis such that the outer edges of the discs open at the convex side of the core during its rotation, to receive the hairs between the outer edges of the discs, and close at the concave side of the arcuate core during its rotation, to clamp the hairs between the outer edges of the discs and to pluck them from the body.

19 Claims, 1 Drawing Sheet

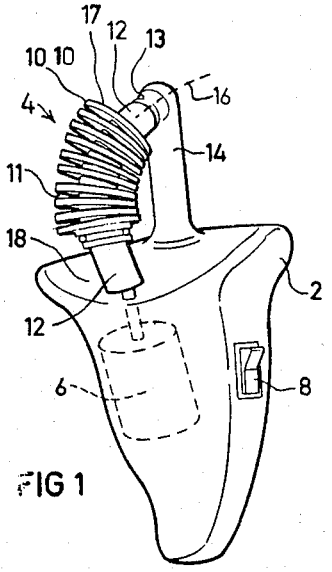
FIG 1
FIG 2
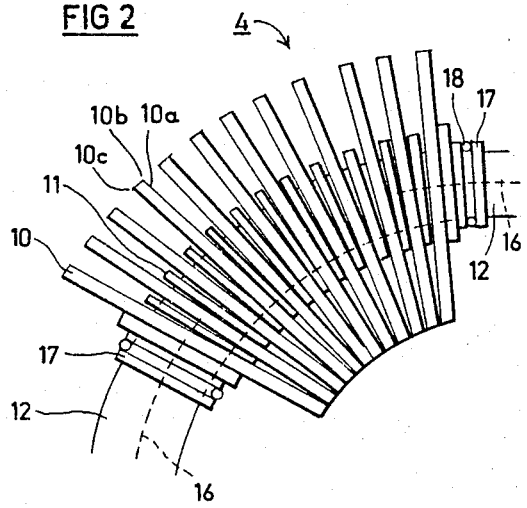
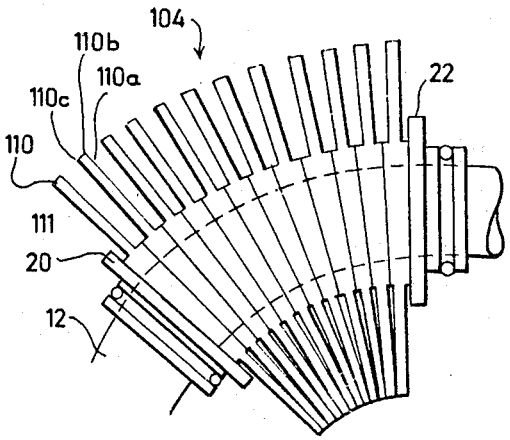
FIG 3
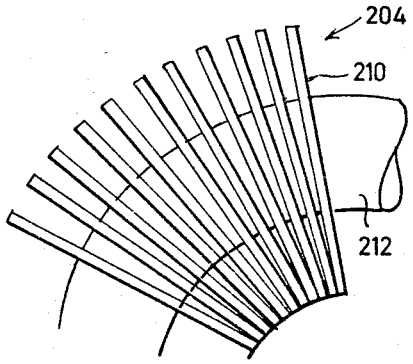
FIG 4

DEVICE FOR REMOVING HAIR

RELATED APPLICATIONS

The present application is related to our application Ser. No. 07/031,760 filed Mar. 30, 1987, now U.S. Pat. No. 4,726,375 of Feb. 23, 1988, and also to our copending application Ser. No. 163,047, filed 3/2/88, both assigned to the same assignee as the present application.

BACKGROUND OF THE INVENTION

The present invention relates to depilatory devices for removing body hair, such as are used for cosmetic purposes.

A number of depilatory devices for this purpose have been proposed in the past. Some devices include discs arranged to provide gaps of wedge-like configurations for catching and plucking the hair; a device of this type is illustrated by U.S. Pat. No. 2,900,661. Other devices include helical springs which define the hair-catching gaps between their windings; examples of the latter are described in U.S. Pat. Nos. 1,232,617, 4,079,741 and 4,524,772. Our patent application Ser. No. 81,779 filed Mar. 4, 1987 discloses a third type device in which the hair-plucker body is in the form of a flexible cylindrical member of plastic material formed on its outer surface with a plurality of slits penetrating only partially through the cylindrical member, which slits open at the convex side of the plastic member during its rotation to receive the hairs, and close at the concave side to clamp and pluck the hairs.

BRIEF SUMMARY OF THE INVENTION

An object of the present invention is to provide a depilatory device having a still further type of hair-plucker body, and producing a number of advantages over the prior devices as will be described more particularly below.

According to the present invention, there is provided a depilatory device for removing body hair, comprising a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved; characterized in that the hair-plucker body comprises a stack of circular discs of uniform diameter fixed to a resilient cylindrical core of smaller diameter passing through their centers; the core being rotated about its longitudinal axis and being supported in an arcuate position such that the outer edges of the discs open at the convex side of the core during its rotation to receive the hairs between the outer tips of the discs, and close at the concave side of the arcuate core during its rotation to clamp the hairs between the outer edges of the discs.

In the preferred embodiments of the invention described below, the opposite sides of each disc are planar at the outer portion thereof and define a right-angle corners with the outer edges of the disc.

In one described embodiment, the circular discs are of uniform thickness for their complete diameters, and each is separated from the next adjacent one by a separator disc of smaller diameter. A second embodiment is described, wherein each of the circular discs has flat planar faces of uniform thickness for its complete diameter except for its central hub portion which is of increased thickness. A still further embodiment is described wherein the circular discs are of plastic (includes elastomeric) material and are integrally formed with the flexible core.

Depilatory devices constructed in accordance with the foregoing features provide a number of important advantages. Thus, the elongations and contractions of the outer surface of the core are amplified by the discs, so that the necessary opening and closing movements of the hair-plucker body may be effected with lower stresses on the core; i.e., by operating it with either a larger arc or at a lower rotational speed. In addition, the described arrangement increases the linear speed of the hair-plucking elements, i.e., the outer edges of the discs with respect to the skin across which these elements move to pluck the hair, because of the large diameter of the discs compared to that of the core. Further, the described arrangement engages the hairs only at the outer edges of the discs, with the inner surfaces of the discs being spaced from each other even when the gaps (at their outer edges ) are closed. The foregoing advantages not only decrease the strain on the hair-plucker body thereby enabling less-expensive materials such as plastics (including elastomers) to be used and increases their useful life, but also results in more effective plucking of the hairs, and more effective ejection of the hairs after they have been plucked.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view illustrating one form of depilatory device constructed in accordcane with the invention;

FIG. 2 is an enlarged fragmentary view illustrating the construction of the hair-plucking body in the device of FIG. 1; and FIGS. 3 and 4 illustrate two further constructions of the hair-plucking body.

DESCRIPTION OF PREFERRED EMBODIMENTS

The depilatory device illustrated in FIG. 1 comprises a manually-grippable housing 2, and a hair-plucker body, generally designated 4, rotatably mounted to the housing and rotated by an electric motor 6. The motor is disposed within housing 2 and is energized and deenergized by an electrical switch 8.

The rotatable hair-plucker body 4 is in the form of a stack of circular discs 10 spaced from each other by separator discs 11, the stack being fixed on a flexible core 12 passing through central apertures formed in discs 10 and 11. One end of the core is received within housing 2 and is coupled to the electric motor 6. The opposite end of core 12 is received within a bearing 13 mounted at the end of a stem 14 projecting axially of housing 2. The arrangment is such that the cylindrical core 12 is supported in the form of a small arc, preferably less than 90°, and is rotated about its longitudinal axis, indicated by arrow 16, when motor 6 is energized.

With reference particularly to FIG. 2, each of the circular discs 10 is of the same diameter. Each disc 10 is formed with a central opening for freely receiving the flexible core 12. The separator discs 11, one being interposed betwwen each pair of adjacent discs 10, are also of equal diameter, but of a diameter substantially smaller than that of the circular discs 10 and only slightly larger than the outer diameter of the flexible core 12. Preferably, the separator discs 11 are thinner than the circular discs 10.

Both the circular discs 10 and the separator discs 11 are freely mounted on the resilient core 12, but the stack is fixed to the core by a pair of collars 17 at the opposite ends of the stack of discs, each collar being fixed to the core by a clamping ring 18.

It will thus be seen that the opposite faces 10*a* of each circular disc 10 are planar and define a sharp, right-angle edge 10*b* with the outer circumferential edge 10*c* of the disc. Thus, when the core 12 is in its arcuate condition as illustrated in FIGS. 1 and 2, and is rotated about its central axis 16, the outer edges 10*c* of the discs 10 open at the convex side of the core during the rotation of the core, such as to receive the hairs between the sharp edges of adjacent discs, and close at the convex side of the core so as to clamp the hairs and pluck them from the body. As the core continues to rotate, the sharp edges 10*b* again reopen to eject the plucked hairs.

Preferably, the core 12 is cylindrical configuration is made of a flexible plastic material, particularly an elastomeric material such as natural or synthetic rubber, polyurethane, or the like. The discs 10 are of a hard elastic material, which may be of metal, but is preferably of plastic, such as nylon resins, acetal resins, polycarbonates, polytetrafluoroethylene, hard rubber, polyurethane, or the like.

Since the plucking edges (10*b*) are in the form of line edges at the outer circumference of the discs 12, the hairs, even smaller hairs are effectively dripped and plucked. Moreover, flexible core 12 is of a relatively small diameter compared to the diameter of the circular discs 10 (preferably being less that one-half its diameter), the elongations and compressions produced in the outer surface of the core 12 are of considerably smaller magnitude than would otherwise be produced in the previously-known helical spring and slitted core arrangements. Moreover, the rotational velocity of the core 12 produces a much larger linear velocity at the plucking edges 10*b* of the circular discs, therey providing a more rapid "plucking" action. In addition, there is considerable space between the circular discs 10, particularly in their open positions, thereby decreasing the possibility of hairs being caught and entangled within the hair-plucking body. Further, because of the large difference in diameter between the core 12 and the outer plucking edges 10*b* of the circular discs 10, the elongations and contractions of the outer surface or the core 12 during its rotation are amplified at the outer plucking edges 10*b* so that the core 12 may be supported in a considerably smaller arc than in the previously known arrangmements and still provide sufficient opening and closing of the gaps in the hair-plucker body to receive, pluck and eject the hairs.

FIG. 3 illustrates a variation in the construction of the hair-plucker body, particularly in the arrangement for spacing the circular discs, therein designated 10 mounted on the flexible core 112. Thus, in the arrangement illustrated in FIG. 3, each of the circular discs 110 has a flat planar face 10*a* of uniform thickness for its complete diameter except for its central hub portion 110*b*, which is of slightly increased thickness so as to space the outer tips 110c of the discs from each other at the convex side of the core 112. In the arrangement illustrated in FIG. 3, the flat planar faces 110*a* of the circular discs 110 also define sharp line edges 110*b* with the outer circumferential edge 110*c* of the disc, as in the FIG. 2 arrangement.

FIG. 4 illustrates a modification in the construction of the hair-plucker body, wherein the discs, therein designated 210, are also of plastic material but are integrally formed with the core, therein designated 212. Preferably, the discs 210 are of a hard elastic material, such as one of those mentioned above, and the core is of an elastomeric material injection- moulded to the discs so as to produce an integrated hair-plucker body. It is contemplated that both the discs 210 and the core 212 of the hair-plucker body illustrated in FIG. 4 may be made of the same material, such as natural or synthetic rubber, or polyurethane, simultaneously produced by injection moulding.

While the invention has been described with respect to several preferred embodiments, it will be appreciated that many other variations, modifications and applications of the invention of the made.

What is claimed is:

1. A device for removing body hair, comprising a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved; characterized in that said hair-plucker body comprises a stack of circular discs of uniform diameter fixed to a resilient cylindrical core of smaller diameter passing through their centers; said core being rotated about its longitudinal axis and being supported in an arcuate position such that the outer edges of said discs open at the convex side of the core during its rotation to receive the hairs between the outer edges of the discs, and close at the concave side of the arcuate core during its rotation to clamp the hairs between the outer edges of the discs.

2. The device according to claim 1, wherein the opposite sides of each disc are planar at the outer portion thereof and define right-angle corners with the outer edges of the disc.

3. The device according to claim 1, wherein said circular discs are of uniform thickness for their complete diameters, and each is separated from the next adjacent one by a separator disc of smaller diameter.

4. The device according to claim 1, wherein each of said circular discs has flat planar faces of uniform thickness for its complete diameter except for its central hub portion which is of increased thickness.

5. The device according to claim 1, wherein each of said circular discs is free on said flexible core, but said stack of discs are fixed to said flexible core by a pair of collars fixed to the flexible core at the opposite ends of the stack.

6. The device according to claim 5, wherein said collars are secured to said flexible core by clamping rings.

7. The device according to claim 1, wherein said central core has a diameter less than one-half the diameter of said circular discs.

8. The device according to claim 1, wherein said circular discs are of metal.

9. The device according to claim 1, wherein said circular discs are of a plastic material.

10. The device according to claim 9, wherein said plastic discs are integrally formed with said flexible core.

11. The device according to claim 1, further including an electric motor within said housing for rotating said stack of discs and flexible core, and an electrical switch carried by said housing for energizing and deenergizing said motor, said core being coupled at one end to said motor, its opposite end being received within a rotatable bearing mounted on a stem projecting axially of said housing, said core being supported in an arc of not more than 90°.

12. A device for removing body hair, comprising a manually-grippable housing; a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved; said hair-plucker body comprising a stack of circular discs or uniform diameter fixed to a resilient cylindrical core of smaller diameter passing through their centers; an electric motor within said housing for rotating said stack of discs and flexible core; and an electrical switch carried by said housing for energizing and deenergizing said motor; said core being coupled to said motor so as to be rotated about its longitudinal axis and being supported in an arcuate position such that the outer edges of said discs open at the convex side of the core during its rotation to receive the hairs between the outer edges of the discs, and close at the concave side of the arcuate core during its rotation to clamp the hairs between the outer edges of the discs.

13. The device according to claim 12, wherein the opposite sides of each disc are planar at the outer portion thereof and define right-angle corners with the outer edges of the disc.

14. The device according to claim 12, wherein said circular discs are of uniform thickness for their complete diameters, and each is separated from the next adjacent one by a separator disc of smaller diameter.

15. The device according to claim 12, wherein each of said circular discs has flat planar faces of uniform thickness for its complete diameter except for its central hub portion which is of increased thickness.

16. The device according to claim 12, wherein each of said circular discs is free on said flexible core, but said stack of discs are fixed to said flexible core by a pair of collars fixed to the flexible core at the opposite ends of the stack.

17. The device according to claim 16, wherein said collars are secured to said flexible core by clamping rings.

18. The device according to claim 12, wherein said central core has a diameter less than one-half the diameter of said circular discs.

19. The device according to claim 12, wherein said plastic discs are integrally formed with said flexible core.

* * * * *